United States Patent [19]

McKinney

[11] Patent Number: 4,919,435

[45] Date of Patent: Apr. 24, 1990

[54] THROWING DEVICE FOR PLAYING GAMES

[75] Inventor: Gary S. McKinney, Delta, Canada

[73] Assignee: Hybos Mfg. Inc., Delta, Canada

[21] Appl. No.: 209,987

[22] Filed: Jun. 22, 1988

[51] Int. Cl.[5] ..... A63B 65/00; A63B 67/00

[52] U.S. Cl. ..... 273/339; 273/343; 273/412; 273/428

[58] Field of Search ..... 273/336–339, 273/343, 427, 428, 412; D21/2, 4, 203

[56] References Cited

U.S. PATENT DOCUMENTS

| | | | |
|---|---|---|---|
| Re. 28,467 | 7/1975 | Curtiss et al. | 273/339 |
| D. 219,822 | 2/1971 | Rockaitis | 273/427 X |
| 2,187,493 | 1/1940 | Gordon | 273/427 |
| 2,584,260 | 2/1952 | Custer | 273/427 |
| 3,507,496 | 4/1970 | Miller | 273/339 |
| 3,595,578 | 7/1971 | Burcenski . | |
| 3,762,710 | 10/1973 | De Coninck | 273/427 |
| 4,071,237 | 1/1978 | Hoogasian . | |
| 4,071,244 | 1/1978 | Richards . | |
| 4,149,723 | 4/1979 | Simon | 273/428 X |
| 4,203,249 | 5/1980 | Bohm . | |
| 4,222,573 | 9/1980 | Adler . | |
| 4,458,902 | 7/1984 | Miller et al. | 273/427 |

*Primary Examiner*—Paul E. Shapiro

*Attorney, Agent, or Firm*—Bull, Housser & Tupper

[57] ABSTRACT

A device for playing games comprising a body portion having a plurality of angularly spaced-apart, generally T-shaped members extending therefrom. The members may be asymmetrically spaced around the body portion.

15 Claims, 3 Drawing Sheets

THROWING DEVICE FOR PLAYING GAMES

FIELD OF THE INVENTION

The invention relates to a throwing device for use in playing games.

BACKGROUND OF THE INVENTION

Some projectile game devices are symmetrical in some manner to provide certain flight characteristics. Such devices include a football, which spins about its longitudinal axis providing aerodynamic stability when thrown through the air. U.S. Pat. No. 4,203,249 refers to a flying saucer or throwing disk used in sports games which includes symmetrically distributed wings around a circular portion to provide aerodynamic stability. U.S. Pat. No. 4,222,573 refers to a boomerang which includes a plurality of symmetrically spaced-apart wings which provide aerodynamic stability. Conventional throwing objects, such as those described above, normally require at least two persons to play a game. When such conventional objects hit the ground, they tend to roll away.

The present invention is a device for playing games having a body portion which includes a plurality of angularly spaced-apart generally T-shaped members extending therefrom.

The invention provides a device which may be used by a single person or several persons to play a game, and which does not tend to roll across the ground. The shape of the device reduces the potential distance it can be thrown to keep it within reasonable bounds.

DESCRIPTION OF THE PREFERRED EMBODIMENTS

Figure 1:
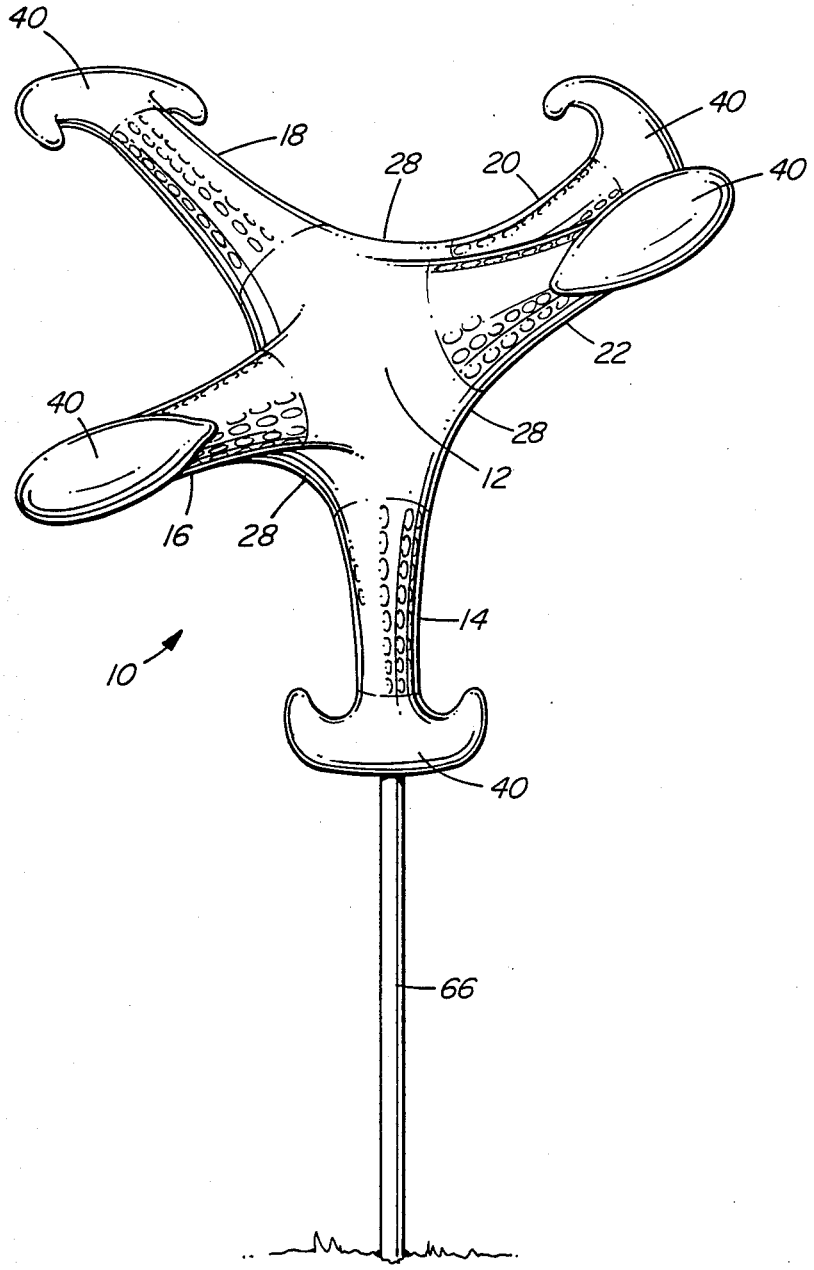
FIG. 1 is a simplified perspective view of an apparatus according to an embodiment of the invention.

Referring to FIG. 1, a first device for playing games is shown generally at 10. The device comprises a body portion 12 having a plurality of generally T-shaped members, including a main member 14 and four other members 16, 18, 20, 22 extending radially therefrom. The members are asymmetrically spaced around the body portion in this embodiment such that each is approximately equidistantly spaced apart from adjacent members. The T-shaped members provide hand holds for catching and throwing the device.

The body portion 12 and the T-shaped members, 14, 16, 18, 20 and 22 are, in the described example, made of a resilient material, such as integral skinned, flexible urethane foam. This resilient material permits the T-shaped members to be flexed during throwing and catching without breakage occurring. There are web portions 28 having a smooth generally hyperbolic shape between the T-shaped members. The smooth shape eliminates sharp edges which could be dangerous when throwing or catching the device.

Figure 2:
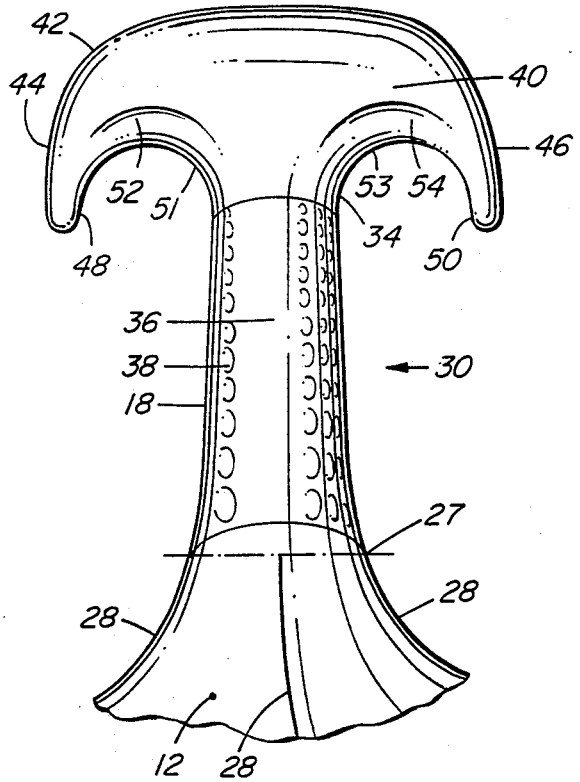
FIG. 2 is a simplified perspective view of a T-shaped member of the invention.

The web portions 28 converge with adjacent T-shaped members to form a truncated conical portion as shown generally at 30 on member 18 in FIG. 2. The conical portion extends from a central part of the body portion 12 towards an outer end 34 of the member. The conical portion 30 provides a handle which can be comfortably gripped by hands of various sizes.

A gripping surface 36 is formed by a plurality of depressions 38 in the resilient material on each conical portion 30 and extends from an inner point 27 on the web portions 28 to the outer end 34 of the conical portion. The gripping surfaces improve hand gripping for throwing or catching the device.

An outer portion 40 is connected perpendicularly to the outer ends 34 of the conical portions 30. The outer portions are oriented at different angles on different members 14, 16, 18, 20 and 22 as shown in FIG. 1. This provides varying degrees of probability that a second device can be hooked by someone holding the first device when the second device is thrown towards the person.

Figure 4:
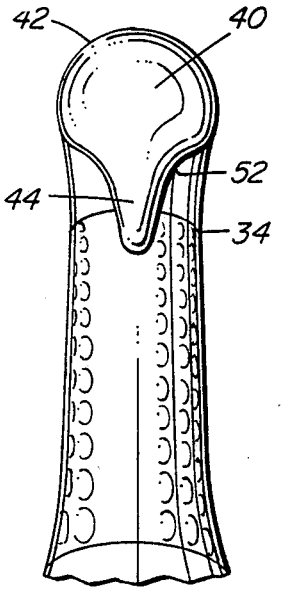
FIG. 4 is a simplified side view of the T-shaped member.
Figure 3:
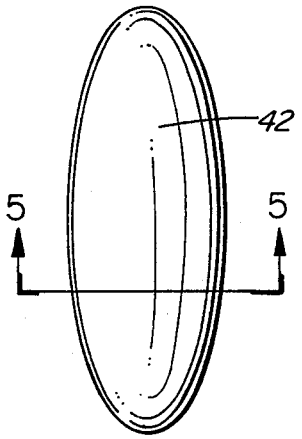
FIG. 3 is a simplified end view of an end portion of the T-shaped member.
Figure 5:
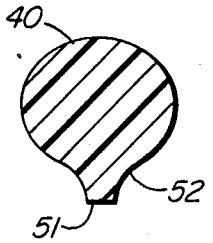
FIG. 5 is a simplified cross-sectional view of the end portion taken along lines 5—5 of FIG. 3.

Referring to FIGS. 2 and 3, each outer portion 40 is generally ellipsoidal in shape having a convex outer surface 42 with no sharp edges. Referring to FIGS. 2 and 4, the outer portions have first and second ends 44 and 46 which are curled inwards towards the body portion 12 forming hooked portions 48 and 50. The hooked portions create saddle portions 51 and 53 between the respective hooked portions and the outer end 34 of the conical portion 30. Referring to FIG. 5, the outer portions are formed to have concave inner surfaces 52 and 54 adjacent respective saddle portions.

Figure 6:
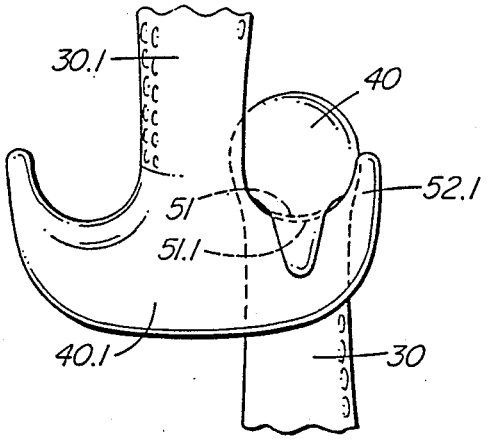
FIG. 6 is a simplified, fragmented, perspective view of two outer portions of two different apparatuses engaged.

In playing a game with the apparatus, an object of the game may be to engage a saddle portion of a member of a first apparatus with one of the saddle portions of a member of a second apparatus as shown in FIG. 6. Second apparatus components are designated by the addition of ".1" to corresponding reference numbers. The concave inner surfaces adjacent each saddle portion increase the engagement of the saddle portions thereby helping to prevent disengagement thereof due to relative twisting movement between the two apparatuses. Thus the engagement of the two saddle portions has saddle stability.

Figure 7:
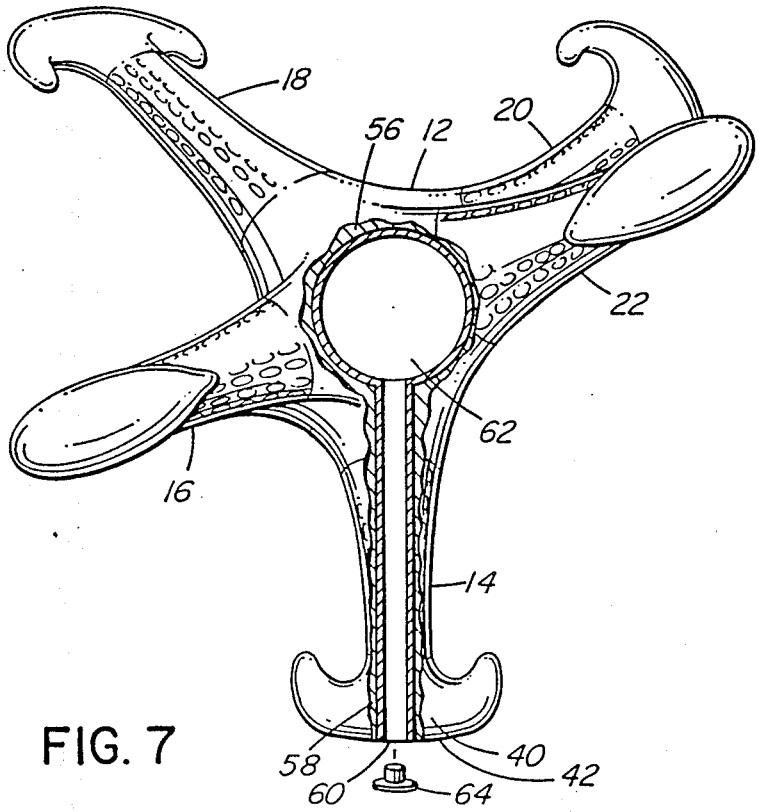
FIG. 7 is a simplified fragmented view of the apparatus showing an insert included therein.

Referring to FIG. 7, the body portion 12 has a hollow interior 56. A passageway 58 extends from the hollow interior through the main member 14 and is accessible by an opening 60 on the surface 42 of the outer portion 40. The hollow interior and the passageway are lined with an insert 62 made of a suitable plastic. The insert forms a reservoir for liquids. This may be used for beverages, for example. A cap 64 fits over the opening providing means for sealing the passageway when the reservoir is holding liquid.

In an alternative embodiment of the invention, the body portion 12 and the T-shaped members 14, 16, 18, 20, 22, are reinforced with a unit mesh material such as tri-woven polyester.

OPERATION

Referring to FIG. 1, a first device 10 may be positioned on a pole 66 driven into the ground. Cap 64 is removed and the pole is fitted into the insert 62 in the passageway of the main member 14. The first device is therefor suspended above the ground with the four remaining members 16, 18, 20 and 22 projecting radially at various angles into space.

A second such device (not shown) may be manipulated by two or more opposing teams which battle to throw the second device towards the first device. The object of such game is to engage the T-shaped members of the second device with the T-shaped members 16, 18, 20 and 22 of the first device so the second device remains suspended.

In an alternate use (not illustrated) of the device a first person holds a first apparatus and a second person holds a second apparatus. The first person throws the first apparatus to the second person who attempts to catch it by engaging a saddle portion of the second apparatus with a saddle portion of the first apparatus.

While a specific embodiment of the invention has been described, such an embodiment should be considered illustrative of the invention only and not as limiting the scope of the invention as construed in accordance with the accompanying claims.

What is claimed is:

1. A device for playing games comprising a body portion having a plurality of angularly spaced apart, generally T-shaped members extending therefrom, the members being non-coplanar and being asymmetrically spaced around the body portion.

2. A device as claimed in claim 1, wherein the body portion has a central part, each of the T-shaped members has a truncated conical portion extending from the central part of the body portion, and an outer portion, perpendicular to the truncated conical portion.

3. A device as claimed in claim 1, wherein there are five T-shaped members which are arranged asymmetrically.

4. A device as claimed in claim 1, wherein the body portion and the T-shaped members are made of a resilient material.

5. A device as claimed in claim 4, wherein the resilient material is reinforced with a omit mesh material.

6. A device for playing games comprising a body portion having a central part, a plurality of angularly spaced apart T-shaped members extending therefrom, the T-shaped members being angularly spaced apart in the three dimensions so the members are non-coplanar, each of the T-shaped members having a truncated conical portion extending from the central part of the body portion and an outer portion perpendicular to the truncated conical portion.

7. A device as claimed in claim 6, wherein each of the outer portions has a hook shaped portion at each end thereof.

8. A device as claimed in claim 7, wherein each of the outer portions has a convex outer surface and tapering outwardly to form said hook shaped portion.

9. A device as claimed in claim 8, wherein the body portion has a hollow interior and wherein there is a passageway extending from the outer surface of one of the outer portions to the hollow interior of the body portion.

10. A device as claimed in claim 9, wherein the hollow interior and the passageway are lined with a liquid impermeable material to form a reservoir for consumable liquids.

11. A device as claimed in claim 10, further including means for sealing the passageway when the reservoir is holding the liquid.

12. A device as claimed in claim 7, wherein the device has saddle shaped portions between the hook shaped portions and an outer end of the conical portion.

13. A device as claimed in claim 12, wherein the device further includes concave inner surfaces adjacent to the saddle shaped portions.

14. A device as claimed in claim 6, wherein each of the truncated conical portions has a gripping surface including a plurality of depressions therein.

15. A device for playing games comprising a body portion with a central part and having five angularly spaced-apart, generally T-shaped members extending therefrom, the members being asymmetrically spaced around the body portion, each of the T-shaped members including a truncated conical portion extending from the central part of the body portion, and an outer portion perpendicular to the truncated conical portion.

* * * * *